US010654676B2

(12) United States Patent
Sundermann et al.

(10) Patent No.: US 10,654,676 B2
(45) Date of Patent: May 19, 2020

(54) APPARATUS FOR AUTOMATICALLY CUTTING AND DISCHARGING A WEB OF MATERIAL, AND ASSOCIATED METHOD

(71) Applicant: Windmöller & Hölscher KG, Lengerich (DE)

(72) Inventors: Fabian Sundermann, Osnabrück (DE); Frank Hoffmann, Greven (DE); Werner Beckonert, Emsdetten (DE); Rolf Kammann, Westerkappeln (DE); Thomas Sehlleier, Coesfeld (DE)

(73) Assignee: Windmöller & Hölscher KG, Lengerich (DE)

( * ) Notice: Subject to any disclaimer, the term of this patent is extended or adjusted under 35 U.S.C. 154(b) by 158 days.

(21) Appl. No.: 15/121,627

(22) PCT Filed: Dec. 17, 2014

(86) PCT No.: PCT/EP2014/078291

§ 371 (c)(1),
(2) Date: Aug. 25, 2016

(87) PCT Pub. No.: WO2015/128025

PCT Pub. Date: Sep. 3, 2015

(65) Prior Publication Data

US 2016/0362271 A1 Dec. 15, 2016

(30) Foreign Application Priority Data

Feb. 27, 2014 (DE) ..... 10 2014 102 604

(51) Int. Cl.
*B65H 35/02* (2006.01)
*B65H 20/14* (2006.01)
(Continued)

(52) U.S. Cl.
CPC ..... *B65H 20/14* (2013.01); *B26D 7/14* (2013.01); *B26D 7/1854* (2013.01); *B26D 9/00* (2013.01);
(Continued)

(58) Field of Classification Search
CPC ..... B26D 7/14; B26D 7/1854; B26D 9/00; B65H 20/02; B65H 20/14;
(Continued)

(56) References Cited

U.S. PATENT DOCUMENTS 4,231,272 A * 11/1980 Crouse ..... B26D 7/1854 226/97.3
4,329,893 A 5/1982 Wong
4,484,500 A 11/1984 Reba et al.

FOREIGN PATENT DOCUMENTS

DE 102005000190 A1 6/2007
DE 102007042025 A1 3/2009
(Continued)

*Primary Examiner* — Stephen Choi
(74) *Attorney, Agent, or Firm* — Rudy J. Ng; Bret E. Field; Bozicevic, Field & Francis LLP

(57) ABSTRACT

The present invention relates to a device (1) for automatically cutting a material web (2) with a longitudinal cutting device (60) using a material web (2) in a longitudinal direction (L) separable in at least a partial web (3) and/or at least a remaining web (4), a discharging device (10) for automatically discharging the produced remaining web (4), a transverse cutting device (70) downstream of a longitudinal cutting device (60) for cutting the remaining web (4) transversely to the longitudinal direction (L).

28 Claims, 6 Drawing Sheets

Figure 1:
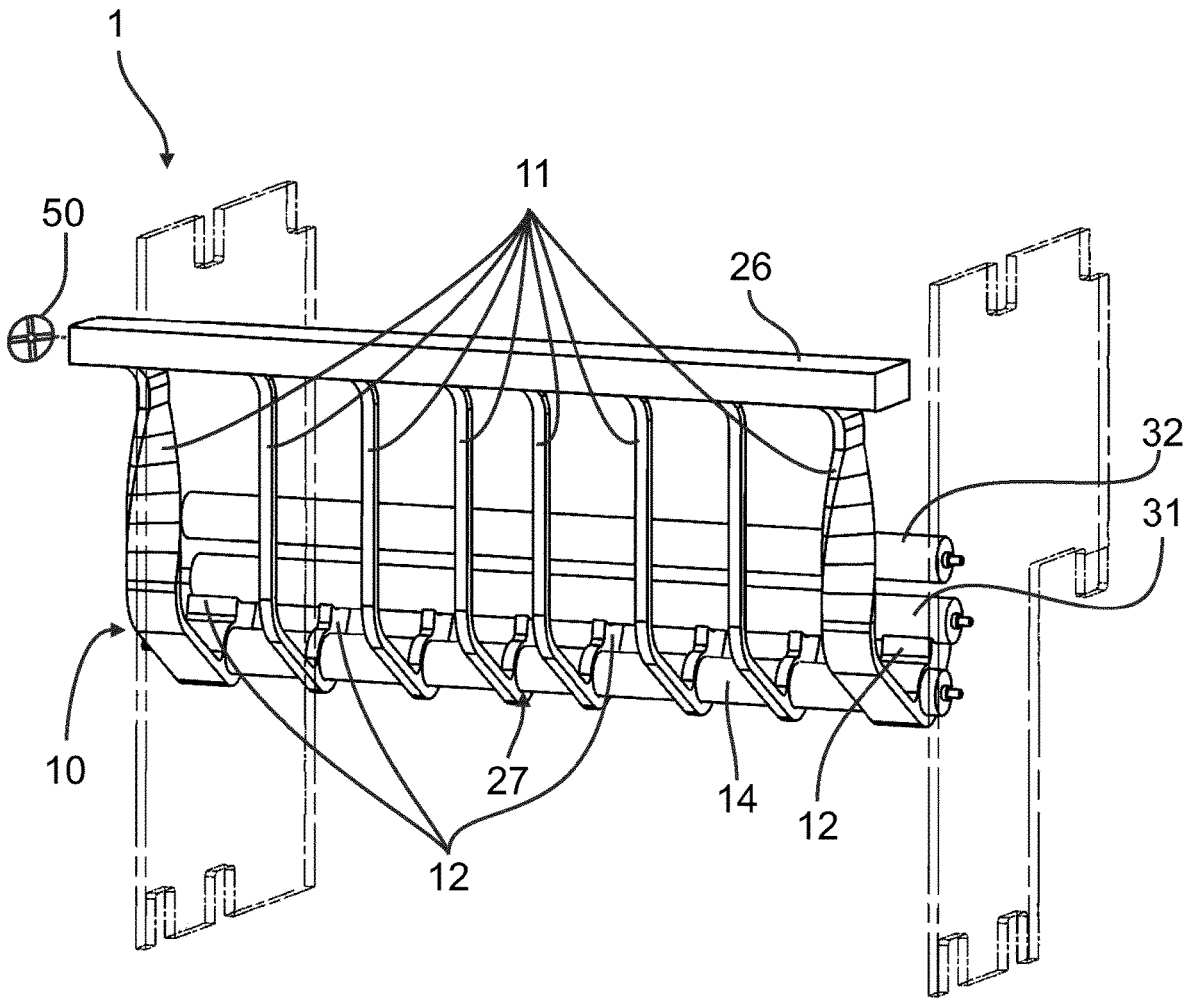

(51) Int. Cl.

| | |
|---|---|
| ***B26D 7/14*** | (2006.01) |
| ***B26D 7/18*** | (2006.01) |
| ***B26D 9/00*** | (2006.01) |
| ***B65H 20/02*** | (2006.01) |
| ***B65H 35/04*** | (2006.01) |

(52) U.S. Cl.
CPC ..... *B65H 20/02* (2013.01); *B65H 35/02* (2013.01); *B65H 35/04* (2013.01); *B65H 2301/41487* (2013.01); *B65H 2301/5151* (2013.01); *B65H 2301/5155* (2013.01); *B65H 2406/31* (2013.01)

(58) Field of Classification Search
CPC .. B65H 2301/41487; B65H 2301/5151; B65H 2301/5155; B65H 2406/31; B65H 35/02; B65H 35/04; Y10T 83/207; Y10T 83/6491
See application file for complete search history.

(56) References Cited

FOREIGN PATENT DOCUMENTS

| | | | |
|---|---|---|---|
| DE | 202011004608 | U1 | 7/2012 |
| EP | 2226144 | A1 | 9/2010 |
| EP | 2505537 | A1 | 10/2012 |
| GB | 2035244 | A | 6/1980 |
| GB | 2116471 | A | 9/1983 |
| WO | WO2009022053 | A1 | 2/2009 |
| WO | WO-2009030491 | A1 * | 3/2009 |

* cited by examiner

APPARATUS FOR AUTOMATICALLY CUTTING AND DISCHARGING A WEB OF MATERIAL, AND ASSOCIATED METHOD

Apparatuses for edge sided cutting of a material web in form of a plastic film web are known. The edge sided cutting of such a material web is ordinary in order to establish a clear edge area of the material web and for example to alter or eliminate width variations.

It has been shown that with higher developed production plants for the production of said material webs like plastic films it is known that the produced edge strips are not only sucked or discharged but that these edge strips are at least coiled for a sorted disposal or recycling or are supplied immediately inline of a recycling.

Since the edge strips are produced by a continuous cut in longitudinal direction, it is necessary in the beginning of the cutting process that mainly the end of the edge strip, meaning the area in which the longitudinal cutting knife enters the material web for the first time for cutting the material web, is further separated transversely towards the longitudinal direction L.

Reference DE 20 2011 004 608 U1 shows a device with which a longitudinal cutting knife separates the material web continuously in a partial web and an edge strip. The longitudinal cutting knife thereby produces an incision which at the same time establishes the dividing line between the partial web and the edge strip. The transverse cutting of the material web, particularly the edge strip, occurs via a transverse separating knife which comprises a cutting blade and a separating device which effects a separation of the edge strip from the partial web before the transverse cutting of the edge strip. With a proceeding approximation of the transverse separating knife at the material web the cutting blade finally separates the edge strip, wherein the material web further supplied in longitudinal direction L in the area of the edge strip accumulates to the cutting blade, stows at this position and is compulsory fed to the discharging device. Disadvantageously, the accelerated separating facility can negatively influence the transverse cutting of the edge strip via the cutting blade. Further, the risk occurs that an uncontrollable accumulation of the material web at the cutting blade results and in special situations no reliable outlet of the edge strip via the discharging device occurs. A further disadvantage is that in the unloading process the strips are not separated from the web after the longitudinal cut, wherein edge effects occur.

The object of the present invention is to provide a device and a method which enable an easy, reliable and safe transverse cutting of the material web, even with high web velocities.

The object of the present invention is solved by all features of claim 1. Preferable embodiments and improvements of the invention are subject matter of the dependent claims.

By a transverse cut or transverse cutting within the scope of the invention a cutting of the remaining web (edge strip) transversely to the longitudinal direction of the supplied material web has to be understood.

The main idea of the invention is that the discharging device is suitable—without foreign help—to discharge the remaining web after the longitudinal cutting. In contrast to that state of the art in which according to reference DE 20 2011 004 608 U1 an external separating facility is integrated at the transverse cutting knife capturing the remaining web and directing it to the discharging device, according to the invention only the discharging device leads to an automatic retracting and discharging of the remaining web. For example, it is possible that such a negative pressure occurs within the discharging device such that automatically after transverse cutting the remaining web is sucked into the discharging device. Further, the present invention comprises the advantage that a plurality of partial webs is producible and the discharging device can discharge multiple remaining webs at the same time which result by cutting the material web.

A main advantage of the invention is that a separation of the remaining web from the partial web occurs previously to the transverse cutting device. This means that after transverse cutting the remaining web is separated from the transverse cutting device from the partial web such that it is avoided that the edges of the remaining web contact the edges of the partial web and therewith negative edge effects or edge defects result.

Advantageously, it can be intended that the discharging device comprises multiple discharging channels in order to suction multiple remaining webs, particularly that the discharging channels are alterable in their position to the material web. Advantageously, the discharging device comprises a pressure means which results in a desired negative pressure in order to reliably suction the remaining webs. The pressure means can for example be a blower which works centrally for each discharging channel. Likewise, it can be intended that each discharging channel comprises an individual pressure means.

It is particularly an advantage that the discharging channels are individually alterable towards one another in their position which depends on the position of the longitudinal cut at the material.

The displacement of the discharging channels can occur manually or automatically via correcting elements such that a complete automatisation of the device according to the invention is possible.

In a further measure improving the invention the discharging device can comprise at least one funnel which is configured with an inlet in order to discharge the remaining web. Advantageously, each discharging channel comprises an individual funnel in order to discharge the remaining web at its inlet. In the funnel a corresponding negative pressure is adjusted during an automatic cutting of the material web, wherein automatically the remaining web is sucked through the inlet of the funnel. Within the scope of the invention by "funnel" a component has to be understood that not necessarily comprises an alterable cross section. For example, it is possible that the funnel comprises a constant cross section or a variable cross section. The term "funnel" can within the scope of the invention be equalized with the term "nozzle".

Further, it can be an advantage that the discharging device can be positioned at a first roller which serves for a transport of the material web, wherein particularly the geometry of the funnel in the area of the inlet is at least adjusted to the geometry of the first roller. The first roller can, for example, further transport the partial web or partial webs wherein, for example, at a first web a corresponding deflection of the transport direction of the partial web or the partial webs occurs. Advantageously, the longitudinal cutting device is assembled upstream of the first roller, wherein the transverse cutting device is downstream the first roller. For reliably guiding the remaining web from the discharging device the discharging device is assembled as near as possible to the first roller. Via the resulting negative pressure within the funnel an air stream occurs from the outside through the inlet, wherein according to the invention a beneficial air stream results at the inlet which reliably guides the remaining web into the funnel. Preferably, the first roller comprises a cylindric form and rotates about an axis wherein the geometry of the funnel within the area of the inlet is configured as a segment of a circle. Therewith, the funnel can be guided as near as possible to the first roller wherein a corresponding negative pressure within the funnel is adjusted which manages to automatically pull the remaining web in the discharging device after transverse cutting.

Further, the invention can intend that within the funnel a preferential roller is assembled in order to discharge the remaining web in an improved manner. Advantageously, the preferential roller, which is likewise adjusted about a rotation axis, is located within the funnel and absorbs the remaining web after a transverse cut outside the discharging device occurred. Through the rotation of the preferential roller an active conveyance or an active transport of the remaining web occurs in the direction of the discharging channel wherein advantageously further a corresponding negative pressure within the respective funnel is provided via the pressure means of the discharging device. Via the rotation of the preferential roller a continuous tension in the remaining web and a reliable separation of the remaining web from the partial web results. Advantageously, hereby it can be achieved that negative edge effects at the partial web and/or at the remaining web and an undermining of the partial web by the remaining web is avoided.

Advantageously, the preferential web can extend through a plurality of neighbouring funnels adjusted next to one another wherein particularly each funnel comprises a breakthrough. Additionally and/or alternatively, the funnel with its funnel housing serves for continuous increase of the flow velocity of the air wherein at the same time air turbulences are reduced. Hereby, it can be an advantage that a funnel housing comprises a funnel-like geometry, particularly, is narrowed in its cross section.

A measure improving the invention can intend that the preferential roller is pivotably assembled within the funnel in a way that a first air stream which streams underneath the preferential roller configures a second air stream which streams above the preferential roller. Hereby, it is possible that the preferential roller is assembled within the funnel in a way that the first air stream reliably sucks the remaining web from the outside into the funnel. The second air stream which streams above the preferential roller effects that the remaining web is reliably released from the rotating preferential web. The first air stream can further comprise the function to push the remaining web reliably at the preferential roller in order to ensure a satisfying transport of the remaining web through the discharging device. The volume stream of the first air stream can according to an aspect of the invention be greater than the second air stream which streams above the preferential roller.

Further, it can be advantageous that at least a closing element is intended which can be moved between a closing position and an opening position wherein in the closing position an opening of the funnel is closed and in the opening position the opening of the funnel is opened. Via the closing element in the closing position the negative pressure within the funnel can be increased wherein an interruption of the tension in the material web is at the same time reduced during transversal cutting. This means that during transverse cutting advantageously the closing element is in the closing position. In case the beginning of the remaining web is within the discharging device and is reliably discharged particularly by the preferential roller, the closing element can be transferred into the opening position in order to effect an additional air stream in the inside of the funnel. Hereby, advantageously the performance of the pressure means can be reduced during operation in order to produce the same volume stream.

Further, the invention comprises that in the area of the inlet, particularly downstream to the first roller, the transverse cutting device is assembled. Via the negative pressure within the funnel the remaining web is pushed at the transverse cutting device and is separated such that the beginning of the remaining web is automatically sucked into the funnel and correspondingly captured by the air stream.

In a further measure improving the invention the discharging device can at least comprise an auxiliary roller which can be brought between two positions wherein in the first position the auxiliary roller acts at the first roller and in the second position the auxiliary roller is spaced apart to the first roller. In order to avoid material web tension breaks, cutting disruptions, web ruptures etc. the auxiliary roller preferably is in the first position. In case a transverse cut occurs, particularly in the area of the longitudinal cutting direction, no disruption of tension occurs in the material web which would be disadvantageous. Advantageously, the control of the auxiliary roller occurs via a control unit, particularly sensors can be provided which recognize in how far a transverse cutting has already occurred or the remaining web is already reliably in the discharging device. For example, it is possible that a gear transfers the auxiliary roller in its respective position wherein particularly the gear can be a pneumatic gear. Alternatively and/or additionally, the closing element can possess a separate gear wherein a pneumatic gear is likewise possible.

Preferably, the auxiliary roller can be pivotably mounted at the funnel. Further, the invention can comprise that the auxiliary roller is pivotably mounted at a housing element wherein particularly the housing element comprises the closing element. Likewise it can be intended that the auxiliary roller is moved linearly between said positions. A combination from turning and linear guidance of the auxiliary roller is likewise possible within the scope of the invention in order to bring the auxiliary roller between both positions. Further, it is possible that the closing element and the auxiliary roller can be combined such that only one actuator for moving in the suitable position is necessary. The housing element can be assembled pivotably and/or moveably in the device according to the invention in order to move the auxiliary roller and/or the closing element into the desired position.

Further, the invention can be improved in a way that the inlet of the funnel in the direction of the transverse cutting device comprises an enlarged area which is clear from the first roller. A clearance is established through the enlarged area of the inlet through which reliably air streams can reach the funnel from the outside without that the first roller hinders the air stream. Particularly, advantageously an enlarged area within the scope of the invention has shown that an automatic discharging of the remaining web occurs after transverse cutting via the discharging device. A great air stream proceeds from the outside through the enlarged area wherein the air stream at the same time reliably absorbs the transversely separated remaining web.

Advantageously, the discharging device comprises a suction space in which discharging channels end. In the suction space the remaining webs can correspondingly be transferred, particularly, distributed in order to, for example, enable a processing or recycling of the remaining web and/or enable a specific removal of the remaining web.

In a further embodiment of the invention the preferential roller can at least partially extend from the funnel wherein particularly within the funnel a stream occurs which streams underneath the preferential roller. For example, the funnel housing can be configured in a way that at least partially the preferential roller extends from the funnel. In such an embodiment it can be possible that only a stream within the funnel occurs, which, for example, streams underneath the preferential roller and has the function of the first air stream. An advantage of this embodiment is that the preferential roller and/or the funnel are easy to mount and changeable.

The transverse cutting device can comprise a cutting blade which is configured jagged. Likewise it is possible that the transverse cutting device is moveable and/or disposable independently from the discharging device at the material web. Likewise, the invention comprises that the discharging device comprising the transverse cutting device is moveable from a distant position to the material web which for example corresponds to a permanent operating position in a nearer position to the material web which comprises the cutting position in which the transverse cutting device separates the remaining web. After the transverse cutting of the remaining web is effected in this manner and the remaining web is absorbed from the discharging device, again a distant position to the material web can be taken such that the risk of injury by the transverse cutting device is minimized for a user. Alternatively, it can be intended that the transverse cutting device is assembled extendable at the discharging device, particularly at the funnel.

According to the present invention the material web can be configured as a plastic film or a web from paper, textile, woven, aluminium foil, cupper foil or such like.

Advantageously, the longitudinal cutting device can comprise natural knife elements, cutting elements or wedges in order to be able to perform a corresponding longitudinal cut in longitudinal direction. However it is possible to perform the longitudinal cut by a beam of a medium like water. Also welding means like a laser are possible as a cutting means. In comparison to the longitudinal cutting direction with knifes or wedges these cuttings means have the advantage not to wear. They comprise however the disadvantage to have a high media and energy consumption. The longitudinal cut is further possible with two scissor rollers proceeding against one another.

Advantageously, the transverse cutting device, which is assembled further downstream than the longitudinal cutting device, can be intended with a control unit. This control unit can calculate the time difference in which the transverse cutting device enters the material web. An advantage of the automatically working transverse cutting device is that the cross section for separating the remaining web from the material web doesn't have to be performed manually which is complicated during the operation of the machine and therefore results in a machine shutdown.

Advantageously, the funnel and/or the preferential roller can be assembled in a way to the longitudinal cutting device that from the longitudinal cutting device the remaining web is separated from the partial web. The invention further comprises that the preferential web can be assembled in the overall arrangement that the separation starting from the longitudinal cutting direction from the position of the preferential web and/or the first web and/or the second web results.

Further, said object is solved by a method as described herein. Particularly advantageously is, that the discharging device serves for the fact that the transversely separated remaining web reaches the funnel reliably from the outside. All advantages of the device according to the invention can be further related to the method according to the invention.

Advantageously, the transversal cutting of the remaining web can occur time delayed to the longitudinal cutting of the longitudinal cutting device. Herefore, a control unit can be used which correspondingly activates the longitudinal cutting device and/or the transverse cutting device.

A particular advantageous embodiment of the invention is that the pressure within the funnel is adjusted by a closing element which particularly can be brought between a closing position and an opening position wherein in the closing position the opening of the funnel is closed and in the opening position the opening of the funnel is opened. Advantageously, before transverse cutting of the remaining web the closing element can take the closing position, particularly in case the discharging device reliably discharges the remaining web the closing element is transferred into the open position. Therewith, a corresponding negative pressure within the funnel is provided before the transverse separation, wherein during the transverse separation it is achieved that the transversely separated remaining web reliably reaches the funnel. In case after a certain time a reliable discharge of the remaining web occurs the closing element can be transferred to the opening position wherein an additionally air inlet results which for example can effect that the remaining web is reliably separated or is not stuck to the preferential roller.

Advantageously, an auxiliary roller can abut at the first roller when the transverse cutting occurs in order to avoid an interruption of the tension in the material web. Said auxiliary roller can preferably be brought between two positions, wherein in the first position the auxiliary roller acts at the first roller and in the second position the auxiliary roller is spaced apart to the first roller. When the auxiliary roller is in the second position a continuous tension in the remaining web occurs and a reliable separating of the remaining web to the partial web.

Advantageously, within the funnel a preferential roller can be assembled which reliably discharges the remaining web. The preferential roller prefers the discharge of the remaining web within the discharging device and a reliable separation wherein a continuous tension in the remaining web is effected.

Advantageously, the method enables that a plurality of remaining webs can be discharged at the same time when they are located parallel to one another. Herefore, multiple funnels within the discharging device are intended wherein in the discharging channels the remaining webs are led through which are downstream of the funnel.

Particularly, preferably it can be intended that the separation of the remaining web from the partial web occurs previously to the transverse cutting device, particularly the separation of the remaining web from the partial web occurs previously to the discharging device. The immediate separation of the remaining web from the partial web has the advantage that the remaining web cannot hit with the partial web after a transverse cutting has occurred. Therewith, effectively edge effects at the remaining web can be avoided.

Further, it can be intended that the funnel and/or the preferential roller are assembled to the longitudinal cut direction in a way that after transverse cutting at the longitudinal cut direction the remaining web is separated from the partial web.

Preferably, all features of the device claims can be combined with all features of the method claims.

Figure 2A:
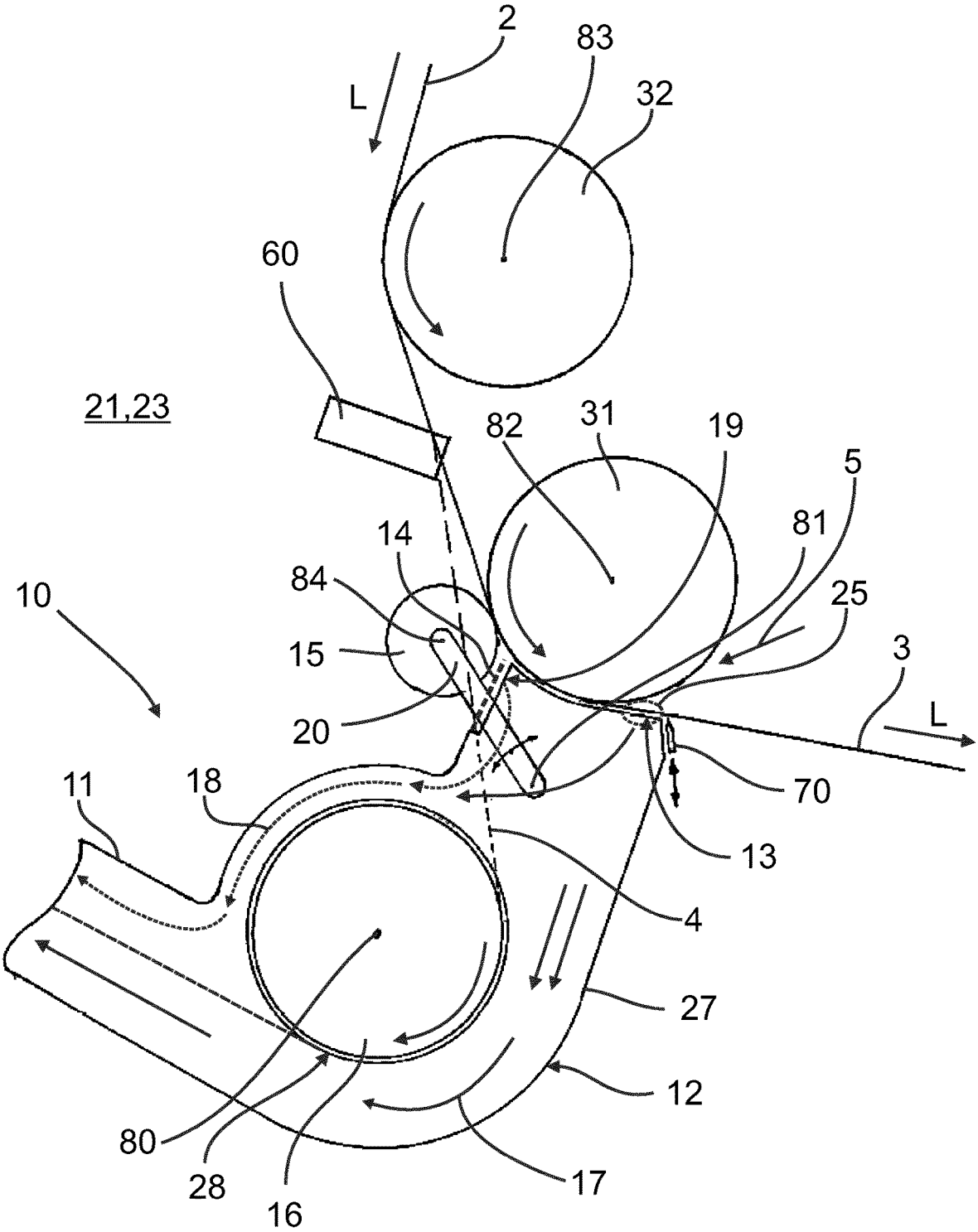
Figure 3:
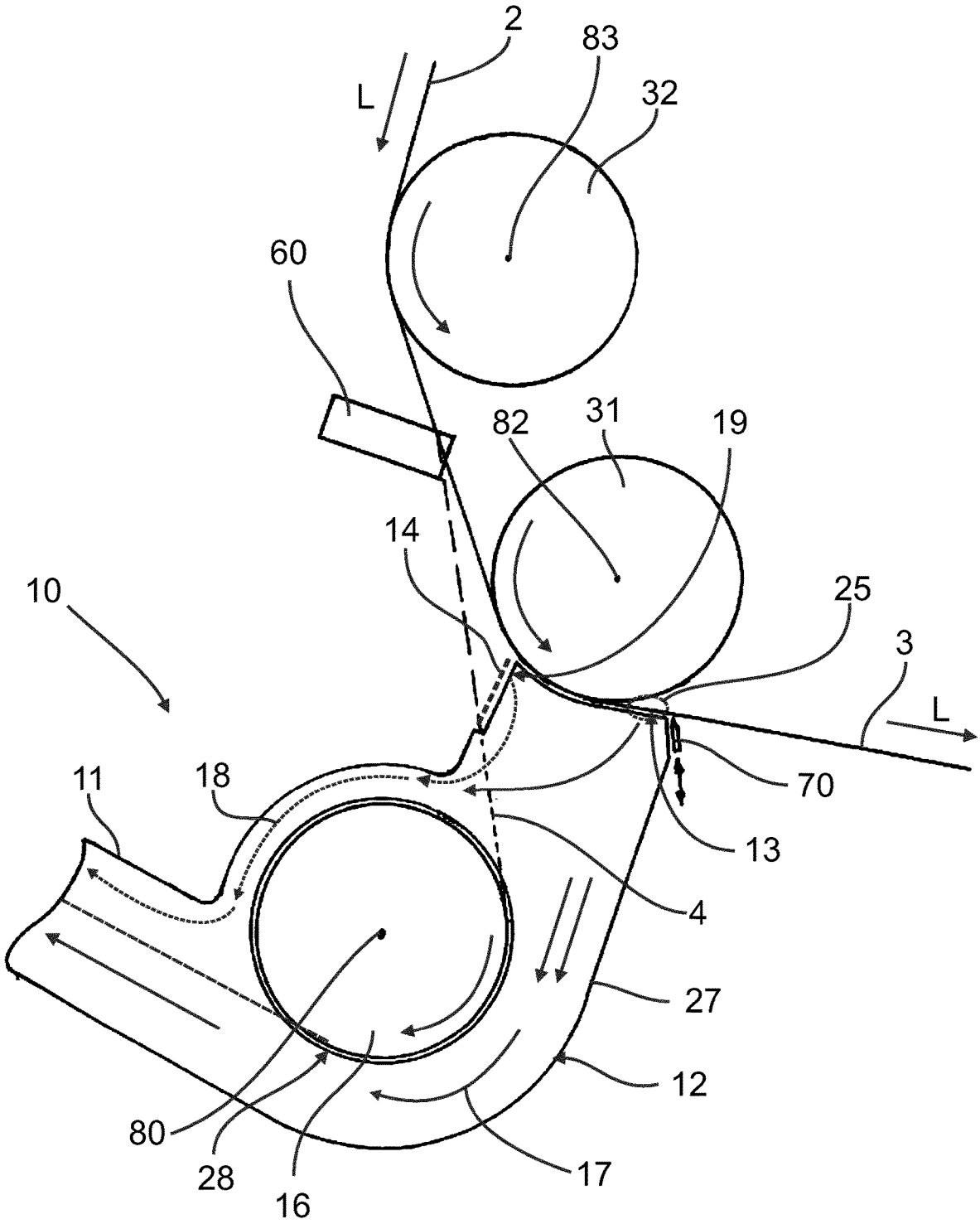
Figure 4:
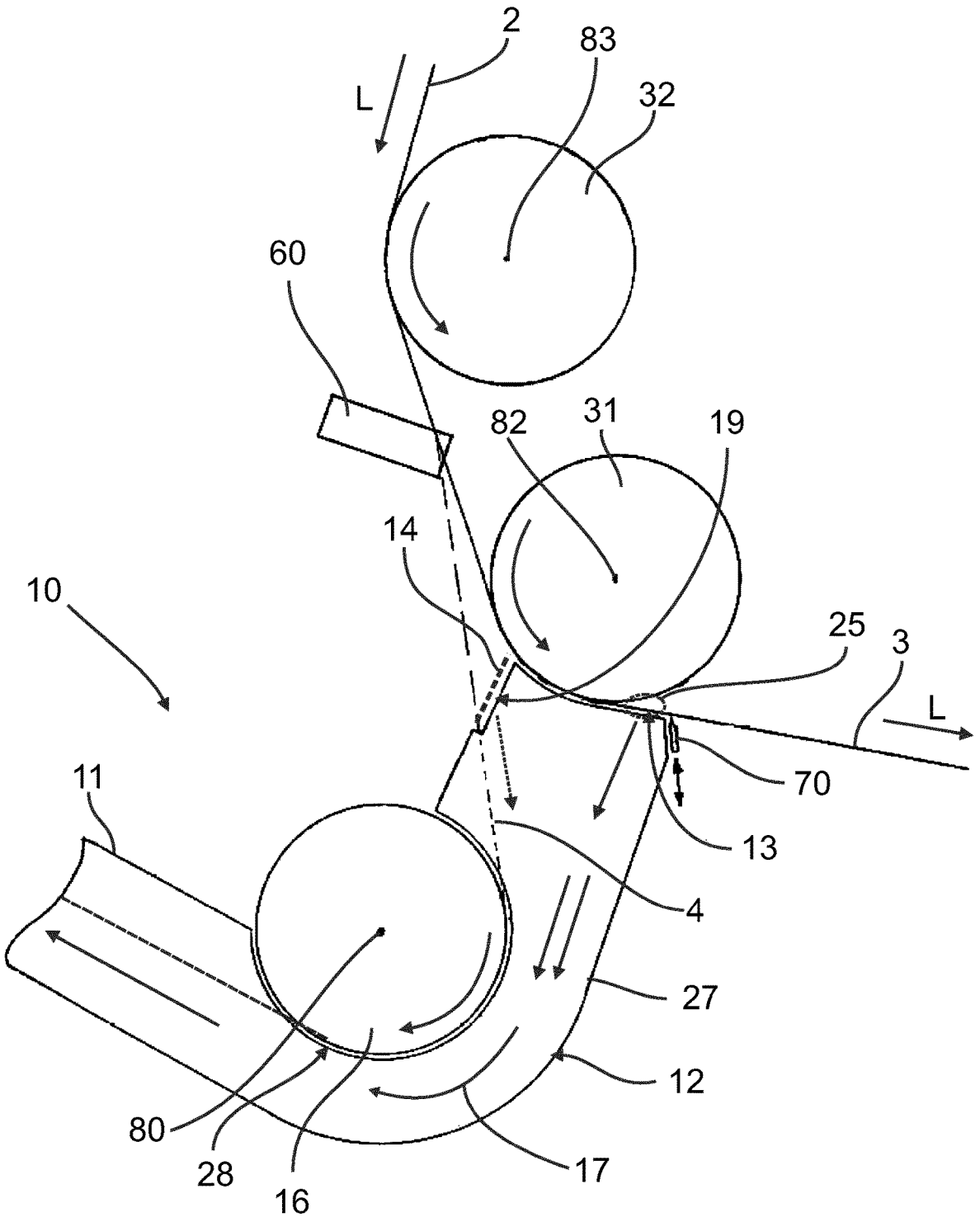
Figure 5:
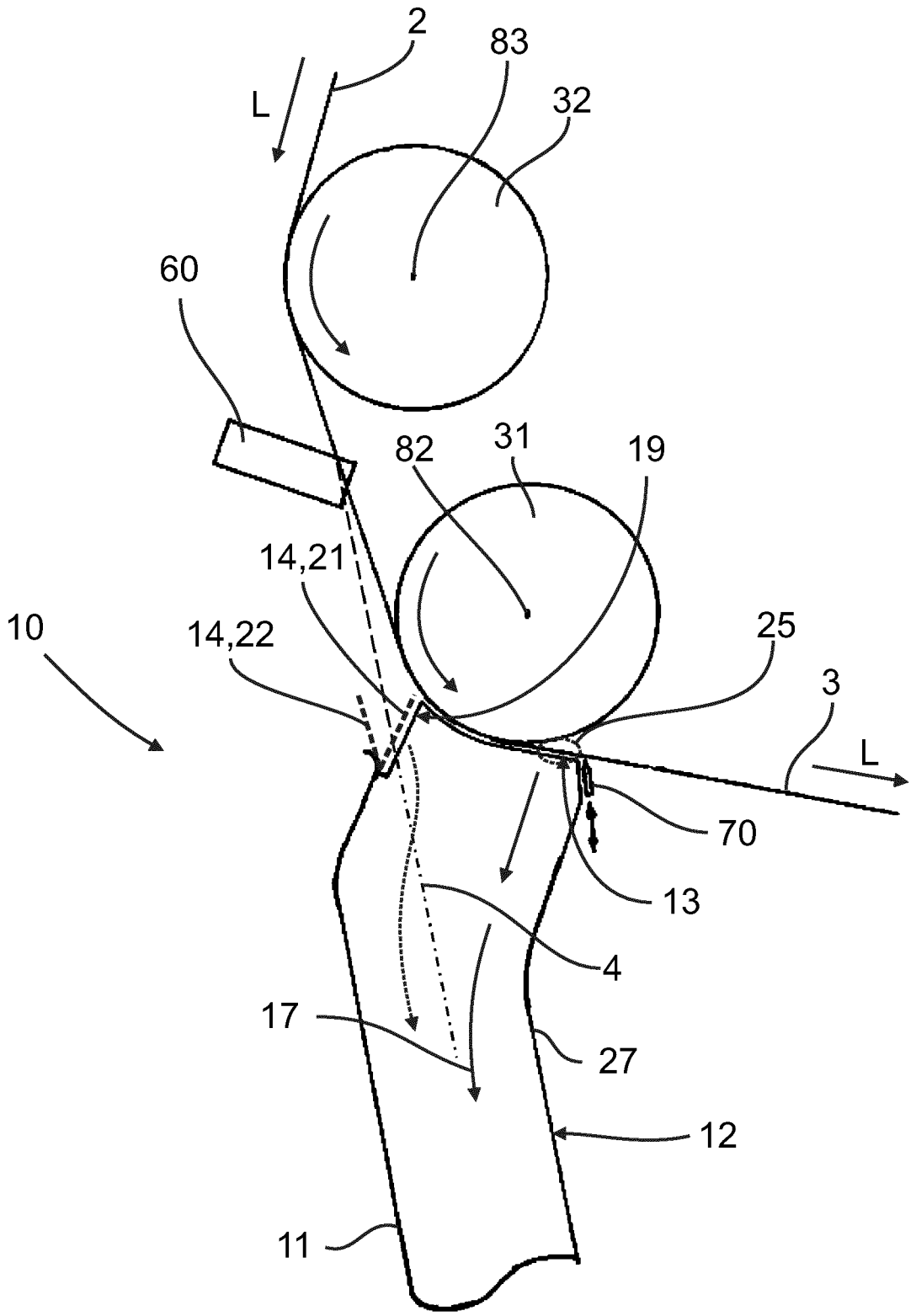

Further advantages, features and details of the invention result from the subsequent description in which embodiments of the invention are described in detail in accordance with the drawings. Thereby, the features described in the claims and in the description can be essential for the invention each single by itself or in any combination. It is shown:

FIG. 1 a lateral view for automatic cutting of a material web according to the invention, FIG. 2*a, b* a possible embodiment of the device according to the invention according to FIG. 1, FIG. 3 a further embodiment of the device according to FIG. 1, FIG. 4 a further embodiment of the device according to the invention according to FIG. 1, and FIG. 5 a further embodiment of the device according to the invention according to FIG. 1.

In FIG. 1 a possible embodiment of a device 1 for automatic cutting of the material web 2 is shown. The material web 2 is shown simplified in FIG. 2 to FIG. 5 which is cut via a longitudinal cutting device 60 and a transverse cutting device 70 which is described subsequently. The device 1 comprises a discharging device 10 which comprises multiple discharging channels 11 wherein each discharging channel 11 ends in a suction space 26. At the edge on the opposite side of the suction space 26 of the suction channel 11 a funnel 12 is intended, respectively, which comprises an inlet 13 as an opening.

Further, a first roller 31 is shown which is assembled spaced apart from the second roller 32. The material web 2 is guided and moved in longitudinal direction L via the second roller 32 in the direction of the first roller 31. Between both rollers 31, 32 a longitudinal cutting device 60 is assembled which cuts continuously in longitudinal direction L the material web 2 in at least a partial web 3 and a remaining web 4. In the present embodiment a cutting of the material web 1 occurs at multiple positions such that a plurality of partial webs 3 and remaining webs 4 results. The material web 2 can, for example, be a plastic film web which, for example, is continuously produced as blow or flat film and is introduced in the longitudinal direction L of the device 1 according to the invention.

For example the longitudinal cutting device 60 can comprise knife elements in order to effect the described longitudinal separation at the material web 2.

In order to reliably discharge the remaining web 4 and separate it from the partial web 3 downstream of the longitudinal cutting device 60 a transverse cutting device 70 is intended which penetrates with a not explicitly shown cutting element in the area of the remaining web 4. Hereby, a cut at the remaining web 4 occurs transversely to the longitudinal direction L. The blower 50 produces a corresponding negative pressure in the discharging device 10, particularly in the funnel 12, such that after transverse cutting automatically the air stream 5 acting from the outside leads the remaining web 4 into the funnel 12. The funnel 12 is positioned possibly near to the first roller 31 in order to reliably suck in the remaining web 4 into the funnel 12. It is particularly advantageous that in all embodiments the geometry of the funnel 12 in the area of the inlet 13 through which the remaining web before it is sucked into the funnel 12 is at least partially adjusted to the geometry of the first roller 31. Hereby, beneficial pressure relations within the funnel 12 can be achieved wherein at the same time it is ensured that reliably the transversely separated remaining web 4 reaches the funnel 12.

Like it is shown in all embodiments, the device 1 comprises a schematically shown closing element 14 which is moveable between a closing position 21 and an opening position 22. The opening position 22 is only shown in FIGS. 2*b* and 5 wherein the closing element 14 is transferable in such positions 21, 22 according to all figures. Particularly, in FIGS. 2 to 4 the closing element 14 is shown in the closing position 21. The funnel 12 comprises an opening 19 which can be closed or opened by the closing element 14.

The discharging device 10 comprises an auxiliary roller 15 according to FIG. 4 which is moveable or pivotable between two positions 23, 24 wherein in the first position 23 the auxiliary roller 15 abuts at the first roller 31 and in the second position 24 the auxiliary roller 15 is spaced apart to the first roller 31. Before the transverse cutting via the transverse cutting device 70 occurs, initially a longitudinal cut via the longitudinal cutting direction 60 occurs wherein the auxiliary roller 15 acts at the first roller 31 which is shown in FIG. 2*a*. The advantage is that with an abutting of the auxiliary roller 15 at the first roller 31 a draw interruption in the material web 2, particularly in the area of the longitudinal cutting device 60, is avoided. The discharging device 10 provides after transverse cutting that the remaining web 4 is reliably sucked into the funnel 12. In case a reliable discharge of the remaining web 4 occurs in the discharging device 10 the auxiliary roller 15 traverses from the first position 23 (FIG. 2*a*) in the second position 24 (FIG. 2*b*).

Figure 2B:
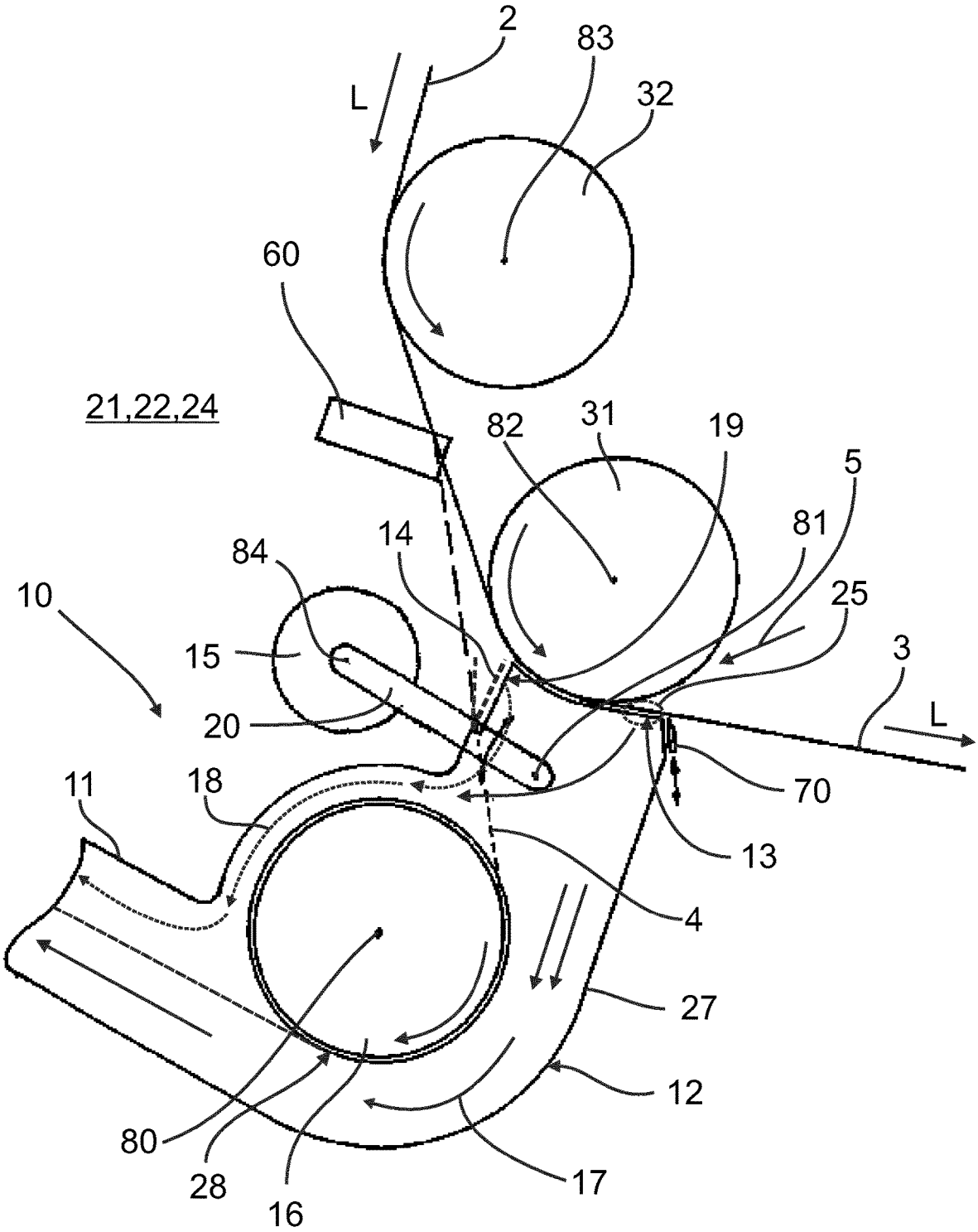

According to FIGS. 2 to 4 the device 1 according to the invention comprises a preferential roller 16 which is assembled within the respective funnel 12. Like shown in FIG. 1, the preferential roller 16 penetrates all funnels 12 assembled next to one another wherein the preferential roller 16 rotates about the axis 80 wherein the device 1 is in operation. The preferential roller 16 rotates clockwise and effects an improved discharge of the remaining web 4 in the direction of the discharging channel 11, particularly in the direction of the suction space 26. Hereby, a first air stream 17 is established which streams underneath the preferential roller 16 and a second air stream 18 which streams above the preferential roller 16. The first air stream 17 facilitates that the remaining web 4 is guided reliably at the preferential roller 16 and subsequently the remaining web 4 is transported reliably in the direction of the discharging channel 11. A continuous draw demand to the material web 2 results wherein a reliable separation of the remaining web 4 from the partial web 3 occurs in the area of the longitudinal cut device 60 in case the auxiliary roller 15 is at its second position 24 according to FIG. 2*b* and the closing element 14 is in the opening position 22 which is only shown in FIG. 5.

The second air stream 18 which streams above the preferential roller 16 effects that the remaining web 4 reliably resolves itself from the preferential roller 16 and therewith no adherence effects of the remaining web 4 result at the preferential roller 16.

In a possible embodiment of the invention which is shown schematically in FIG. 2 the auxiliary roller 15 is pivotably mounted at the funnel 12. Hereby, the auxiliary roller 15 is assembled at the housing element 20 which is pivotable about an axis 81. The auxiliary roller 15 is at the same time rotatable about the axis 84. The movement of the housing element 20 can occur via a gear, particularly, an electric or pneumatic gear which is not explicitly shown. Likewise it is possible that the auxiliary roller 15 can be moved linearly between both positions 23, 24.

Further, according to FIGS. 2*a* and 2*b* it can be included that the closing element 14 is assembled at the auxiliary roller 15, particularly at the housing element 20, and is integrated. Thus, when the auxiliary roller 15 is moved between both positions 23, 24, at the same time a movement of the closing element 14 in its closing position 21 or in the opening position 22 occurs. Preferably, the auxiliary roller 15 is in operative connection with the closing element 14.

In case via a discharging device 10 the remaining web 4 or the remaining webs 4 are reliably discharged an opening process of the closing element 14 occurs wherein additionally ambient air can penetrate through the opening 19 into the funnel 12 which applies for the embodiment according to FIG. 3 to FIG. 5.

In order to reliably suck the remaining web 4 into the funnel 12 after transverse cutting the inlet 13 of the funnel 12 comprises an enlarged area 25 in the direction of the transverse cutting device 70 which is clear from the first roller 31. The enlarged area 25 promotes that from the surroundings a great air stream 5 can penetrate into the funnel housing 27 which at the same time can push the transversely separated remaining web 4 into the funnel 12.

The embodiment according to FIG. 3 shows that it is sufficient without the auxiliary roller 15 from FIG. 2 wherein all features from FIG. 2*a* and FIG. 2*b* are also shown in the embodiment of FIG. 3. Like FIG. 3, FIG. 4 corresponds mainly to the embodiment according to FIG. 2 wherein the funnel housing 27 is differently configured such that at least partially the preferential roller 16 extends through the funnel 12. According to FIG. 4 only a first air stream 17 results which streams underneath the preferential roller 16. The embodiment according to FIG. 4 comprises like FIG. 3 no preferential roller 16 wherein it is possible to combine the embodiment according to FIG. 4 with the preferential roller 16 according to FIGS. 2*a* and 2*b*.

The embodiment according to FIG. 5 mainly corresponds to the embodiment according to FIGS. 2*a* and 2*b* wherein the embodiment according to FIG. 5 is sufficient without preferential roller 16 and without auxiliary roller 15. The other features of the embodiment according to FIG. 5 correspond to the descriptions from the previous described FIG. 2 to FIG. 4.

In all embodiments the transverse cutting of the remaining web 4 occurs time delayed to a longitudinal cutting of the longitudinal cutting device 60. The pressure within the funnel 12 can be adjusted among others via the closing element 14 which is moveable between the closing position 21 and the opening position 22. Previous to transverse cutting of the remaining web 4 a closing element 15 takes over the closing position 21. In case after a defined time a reliable discharging of the remaining web 4 occurs via the discharging device 10 the closing element 14 is transferred to the opening position 22 wherein a supporting compensatory air stream streams into the funnel 12 via the opening 19. This compensatory air stream can effect among others that this is transferred into the second air stream 18 or triggers an improved streaming effect within the funnel 12.

According to FIG. 1 which is combinable with all embodiments according to FIG. 2 to FIG. 5 the discharging channels 11 are displaceable among one another in longitudinal direction of the rotational axis of the first roller 31 such that the distance between the discharging channels 11 is adjustable. The material web 2 which is transported via the rollers 31, 32 can be cut diversely wherein at the edge of the material web 2 remaining webs 4 result which can be named edge strips. Like shown in FIG. 1, the funnels 12 are configured broadened left and right in order to suction wider remaining webs 4. Centrally to the broadened funnels 12 narrowed funnels 12 are intended in order to suction remaining webs 4 which are smaller. These more narrow remaining webs 4 can be named as central strips.

It is further possible that the suction space 26 can receive all edge strips and central strips in order to introduce them into the whole process or to convey these remaining webs for disposal. Likewise it can be intended within the scope of the invention according to FIG. 1 that the suction space 26 comprises multiple cavities separated from one another, for example, the broadened discharging channels 11 which are assembled left and right and end into a first cavity and a narrower discharging channel 11 and in a separate second cavity. Therewith, the user of the device 1 according to the invention is free to further process the remaining webs 4 within the separated cavities of the suction space 21 according to a corresponding request. This means that certain remaining webs are, for example, transferred to the whole process and certain remaining webs are to be disposed. According to FIG. 1 each funnel 12 comprises a breakthrough 28 through which the preferable roller 16 extends wherein the geometry of the break through 28 corresponds mainly to the geometry of the preferential roller 16.

REFERENCE LIST

1 Apparatus
2 Material web
3 Partial web
4 Remaining web
5 Air stream
10 discharging device
11 discharging channel
12 Funnel
13 Inlet
14 Closing element
15 Auxiliary roller
16 Preferential roller
17 First air stream
18 Second air stream
19 Opening
20 Housing element
21 Closing position
22 Opening position
23 First position
24 Second position
25 Enlarged area
26 Suction space
27 Funnel housing
28 Break through
31 First roller
32 Second roller
50 Pressure means, blower
60 Longitudinal cutting device
70 Transverse cutting device
80 Axis
81 Axis
82-84 Axis

The invention claimed is:

1. A device for cutting a material web, the device comprising:

a longitudinal cutting device for cutting a material web in a longitudinal direction at least separable in at least a partial web and at least a remaining web;

a discharging device for discharging the produced remaining web; and a transverse cutting device downstream of the longitudinal cutting device for cutting the remaining web transversely to the longitudinal direction, wherein the discharging device comprises at least one funnel which is configured with an inlet in order to discharge the remaining web, the discharging device can be positioned at a first roller which serves for a transport of the material web, the geometry of the funnel in the area of the inlet is at least adjusted to the geometry of the first roller, the geometry of the funnel within the area of the inlet is configured as a segment of a circle, and the device further comprises a closing element which is configurable between a closing position and an opening position, wherein in the closing position an opening of the funnel is closed and in the opening position the opening of the funnel is opened, and wherein the opening is arranged on an adjacent side of the funnel where the inlet is located.

2. The device according to claim 1, wherein a separation of the remaining web from the partial web occurs previous to the transverse cutting device.

3. The device according to claim 1, wherein the discharging device comprises multiple discharging channels in order to suction multiple remaining webs.

4. The device according to claim 3, wherein the discharging device comprises a suction space in which the discharging channels end.

5. The device according to claim 3, wherein the discharging channels are alterable in their position to the material web.

6. The device according to claim 1, wherein within the funnel a preferential roller is assembled in order to improvably discharge the remaining web.

7. The device according to claim 1, wherein the preferential roller is pivotably mounted within the funnel in a way that a first air stream is established which streams underneath the preferential roller and a second air stream is established which streams above the preferential roller.

8. The device according to claim 1, wherein in the area of the inlet downstream to the first roller the transverse cutting device is assembled.

9. The device according to claim 1, wherein the discharging device comprises at least one auxiliary roller which is configurable between two positions wherein in the first position the auxiliary roller acts at the first roller and in the second position the auxiliary roller is spaced apart to the first roller.

10. The device according to claim 1, wherein the auxiliary roller is at least pivotably or moveably mounted at the funnel.

11. The device according to claim 1, wherein the auxiliary roller is pivotably mounted at a housing element.

12. The device according to claim 11, wherein the housing element comprises the closing element.

13. The device according to claim 1, wherein the inlet of the funnel comprises an enlarged area in the direction of the transverse cutting device which is clear from the first roller.

14. The device according to claim 1, wherein the preferential roller extends at least partially from the funnel.

15. The device according to claim 14, wherein within the funnel a stream occurs which streams underneath the preferential roller.

16. The device according to claim 1, wherein the preferential roller extends through a plurality of funnels assembled next to one another.

17. The device according to claim 16, wherein each funnel comprises a break through.

18. The device according to claim 1, wherein at least the funnel or the preferential roller are assembled to the longitudinal cutting device in a way that the remaining web is separated from the partial web-starting from the longitudinal cutting device.

19. A method comprising:

cutting a material web with a device comprising a discharging device which is positioned at a first roller transporting the material web, wherein the device further comprises:

a longitudinal cutting device upstream of the first roller via which the material web is cut in longitudinal direction in at least a partial web and at least a remaining web, a transverse cutting device downstream of the longitudinal cutting device which separates the remaining web transversely to the longitudinal direction, wherein the discharging device comprises a funnel with an inlet facing a first roller, respectively, through which the remaining web reaches the discharging device, wherein:

the inlet of the funnel comprises an enlarged area which is clear from the first roller such that within the funnel a pressure situation occurs wherein after a transverse separation of the remaining web by the transverse cutting device an automatic discharging of the remaining web is affected into the discharging device, the geometry of the funnel within the area of the inlet is configured as a segment of a circle, the device further comprises a closing element which is configurable between a closing position and an opening position, wherein in the closing position an opening of the funnel is closed and in the opening position the opening of the funnel is opened, and the opening is arranged on an adjacent side of the funnel where the inlet is located.

20. The method according to claim 19, wherein the transverse cutting of the remaining web occurs timely delayed to a longitudinal cutting of the longitudinal cutting device.

21. The method according to claim 19, wherein the pressure within the funnel is adjusted by the closing element.

22. The method according to claim 19, wherein previous to the transverse cutting of the remaining web the closing element takes the closing position.

23. The method according to claim 22, wherein the discharging device reliably discharges the remaining web the closing element is transferred to the opening position.

24. The method according to claim 19, wherein an auxiliary roller abuts at the first roller when the transverse cutting occurs in order to avoid an interruption of tension in the material web.

25. The method according to claim 19, wherein within the funnel a preferential roller is assembled which reliably discharges the remaining web.

26. The method according to claim 19, wherein at least the funnel or the preferential roller are assembled to the longitudinal cutting device in a way that after the transverse cutting started from the longitudinal cutting device the remaining web is separated from the partial web.

27. The method according to claim 19, wherein a separation of the remaining we from the partial web occurs previous to the transverse cutting device, particularly the separation of the remaining web from the partial web occurs previous to the discharging device.

28. The method according to claim 27, wherein the separation of the remaining web from the partial web occurs previous to the discharging device.

* * * * *